US006796388B2

(12) United States Patent
O'Meley

(10) Patent No.: US 6,796,388 B2
(45) Date of Patent: Sep. 28, 2004

(54) DRILL DEPTH CONTROL DEVICE

(75) Inventor: Phill O'Meley, Unanderra (AU)

(73) Assignee: Joy MM Delaware, Inc., Wilmington, DE (US)

( * ) Notice: Subject to any disclaimer, the term of this patent is extended or adjusted under 35 U.S.C. 154(b) by 0 days.

(21) Appl. No.: 10/324,333

(22) Filed: Dec. 19, 2002

(65) Prior Publication Data

US 2004/0118578 A1 Jun. 24, 2004

(51) Int. Cl.[7] ..... B23Q 5/00

(52) U.S. Cl. ..... 173/152; 173/4; 173/11; 173/33; 173/36; 173/37

(58) Field of Search ..... 173/27, 31, 37, 173/36, 4, 11, 141, 147, 152, 193–196, 32, 33

(56) References Cited

U.S. PATENT DOCUMENTS 1,519,981 A * 12/1924 Mott ..... 173/34
1,894,446 A * 1/1933 Mckenny ..... 173/112
2,296,816 A * 9/1942 Curtis ..... 173/34
2,840,347 A * 6/1958 Feucht ..... 92/137
3,460,638 A * 8/1969 Millsapps, Jr. ..... 175/85
3,695,364 A * 10/1972 Porter et al. ..... 173/197
3,797,587 A * 3/1974 Klein ..... 173/152
4,757,866 A * 7/1988 Szoke ..... 173/152
5,431,234 A * 7/1995 Klemm ..... 173/184
6,105,684 A * 8/2000 Pointer et al. ..... 173/27

* cited by examiner

*Primary Examiner*—Scott A. Smith
*Assistant Examiner*—Thanh Truong
(74) *Attorney, Agent, or Firm*—James Earl Lowe, Jr.

(57) ABSTRACT

This invention provides a roof bolt installation apparatus including a drill stabilizing mechanism including a base having a cylindrical bore therein, and a stabilizing rod extendable from the base and slidably located in the bore. The rod has a distal end, and a drill stabilizing end plate is mounted on the rod distal end. The roof bolt installation apparatus also includes a drilling unit which is adapted to rotatably carry a drill, the drilling unit being slidably mounted on the drill stabilizing mechanism, and a mechanism for moving the drilling unit along the drill stabilizing mechanism. The roof bolt installation apparatus also includes a drill depth control device including a base, a top adapted to engage the mine roof, and at least two bars connected between the drill depth control base and the drill depth control top. The bars pass through openings in the drill stabilizing plate.

4 Claims, 2 Drawing Sheets

DRILL DEPTH CONTROL DEVICE

BACKGROUND OF THE INVENTION

This invention relates to machines for drilling holes for roof bolts in mines, and more particularly, to such machines that insure that the roof bolt is secured in the mine roof at its proper depth.

Throughout this specification the words "roof bolt" and derivations of these words are taken to include other strata stabilisation stabilization articles and other similar named bolting articles such as rock bolts, anchor bolts, anchor tendons, tendons and any other similar articles which can be used for any purpose including drilling and bolting of ribs, floors, walls and faces of mines and any other location requiring strata stabilization.

SUMMARY OF THE INVENTION

This invention provides a roof bolt installation apparatus including a drill stabilizing means including a base having a cylindrical bore therein, and a stabilizing rod extendable from the base and slidably located in the bore. The rod has a distal end, and a drill stabilizing end plate is mounted on the rod distal end. The roof bolt installation apparatus also includes a drilling unit which is adapted to rotatably carry a drill, the drilling unit being slidably mounted on the drill stabilizing means, and means for moving the drilling unit along the drill stabilizing means. The roof bolt installation apparatus also includes a drill depth control device including a base, a top adapted to engage the mine roof, and at least two bars connected between the drill depth control base and the drill depth control top. The bars pass through openings in the drill stabilizing plate.

Figure 1:
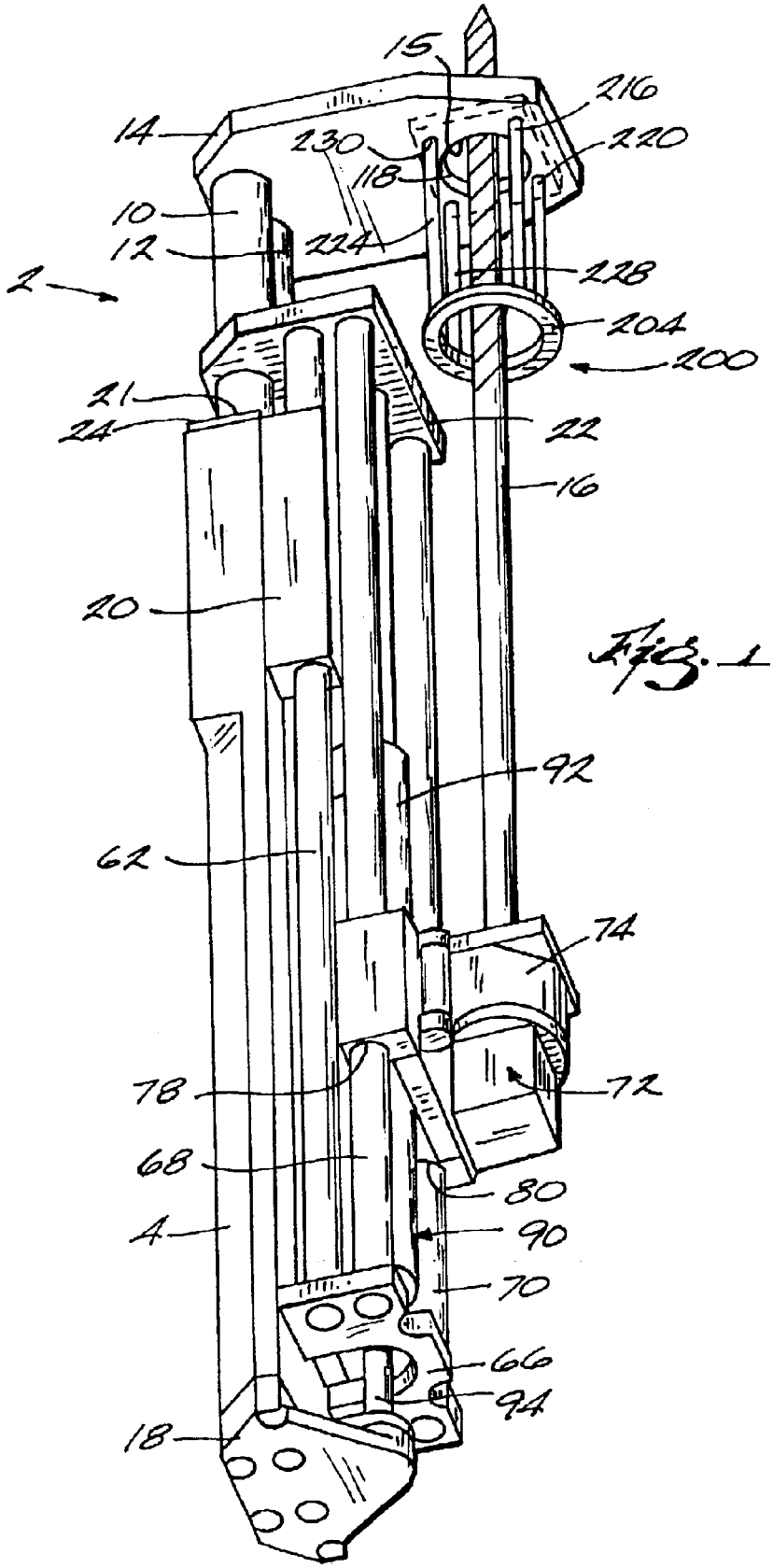
FIG. 1 is a roof bolt installation apparatus including a drill depth control device in accordance with this invention.
Figure 2:
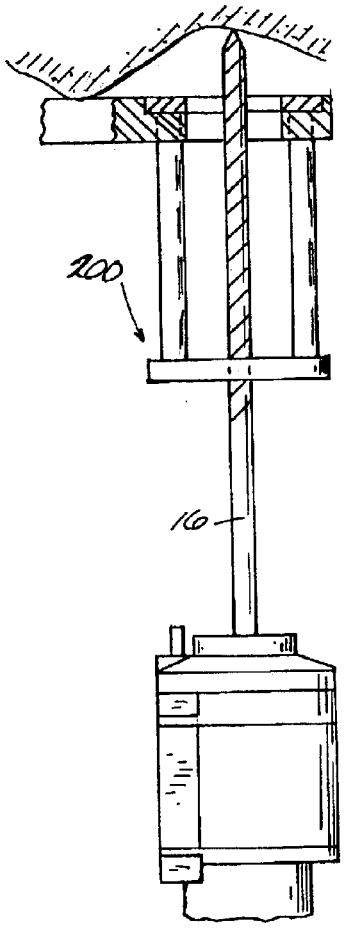
FIG. 2 is a side view of the roof bolt installation apparatus including a drill depth control device shown in FIG. 1 with the drill engaging a mine roof.
Figure 3:
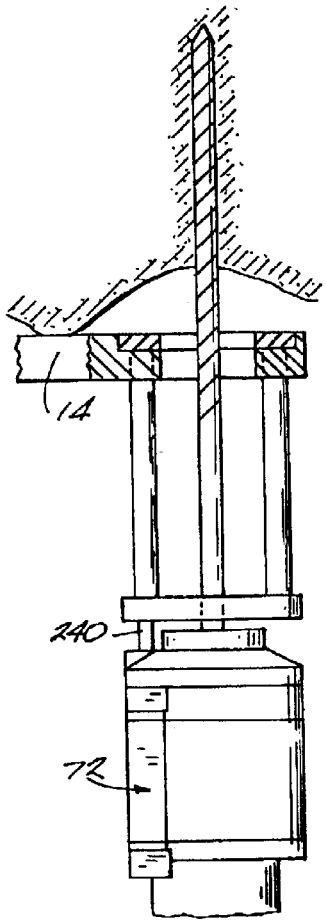
FIG. 3 is a side view of the roof bolt installation apparatus including a drill depth control device shown in FIG. 1 with the drill unit engaging the drill depth control device.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DETAILED DESCRIPTION OF THE EMBODIMENTS

Illustrated in FIG. 1 is a roof bolt installation apparatus or roof bolter 2. This roof bolt installation apparatus 2 includes a drill stabilizing means including a base 4 having a cylindrical bore therein, and a stabilizing rod 10 extendable from the base 4 and slidably located in the bore. The rod has a distal end, and a drill stabilizing end plate 14 is mounted on the rod distal end. The roof bolt installation apparatus 2 also includes a drilling unit 72 which is adapted to rotatably carry a roof bolt 16, the drilling unit 72 being slidably mounted on the drill stabilizing means, and means for moving the drilling unit 72 along the drill stabilizing means.

More particularly, the roof bolter has a first elongated member which acts as base and can also be called a feed carrier 4. The feed carrier 4 includes two elongated cylindrical bores (not shown). The bores each provide a sleeve for the cylindrical rods 10 and 12 to travel or slide in. The feed carrier 4, bores, rods 10 and 12, a rectangular end plate 14 and a ported T-shaped block 18 (which acts as a base member or foot for the roof bolter 2) together form an elongated timber jack 16, which can be used to brace the roof bolter 2 against opposite surfaces of a mine, tunnel or other structure. The T-shaped ported block 18 can be of any other appropriate shape.

The rods 10 and 12 are each connected (by any known means such as bolting or welding) to the end plate 14, to form a second member which is slidably mounted in the feed carrier 4. The slideable mounting of the rods 10 and 12 in the bores of the feed carrier 4 forms a first travel means or mechanism for the roof bolter 2.

The end plate 14 can be manufactured from a high tensile steel or other relatively rigid material. The end plate 14 acts as a guiding means for a drill rod or roof bolt passing through a bore 118, as is illustrated in FIG. 1. More particularly, in one embodiment, the extendable rod end plate 14 includes a guiding opening 15 for the roof bolt 16 placed in a drilling unit 72.

The rods 10 and 12 are of a length so that they will fit inside the bores 6 and 8, so as to fully retract the end plate 14. In the full retracted position, the end plate 14 sits adjacent a generally rectangular guide plate 22, which in turn sits adjacent the top 24 of the feed carrier 4.

The rods 10 and 12 are of circular cross section and are manufactured from high tensile steel, with a hard chrome finish.

Near to the top 24 of the feed carrier 4 is formed or secured two generally rectangular elongated slide blocks 20. The slide blocks 20 have through them longitudinal bores (not shown) which perform the function of sleeves. The slide block 20 carries in the bores, cylindrical feed frame rods 62 of a feed frame. The slide block 20 and the feed frame rods 62 (only one of which is shown) form a second travel means or mechanism of the roof bolter.

The feed frame rods 62 are each joined at one end to the guide plate 22 and at the other end are joined to an end plate 66. The end plate 66 has a horse shoe shaped construction which might also be called U-shaped. Its U-shape is such that the bight of the U opens inward in a direction towards the feed carrier 4. The feed frame rods 62 and 64 are joined to the end plate 66 at the end of the end plate 66 which is closest to the feed carrier 4. The end plate 66 is U-shaped in the preferred embodiment as it is the shape which is considered to provide for ease of installation of a hydraulic cylinder 90. Another shape of end plate 66 could also suffice, such as a rectangular plate which has a hole or aperture in it, so that piston rod 92 can pass through it, which also provides a shoulder against which outer stage cylinder rod 94 abuts.

The guide plate 22 has rods 10 and 12 running through two appropriately sized apertures in the guide plate 22. Once the timber jack 16 is at least partially extended, the rods 10 and 12 will extend beyond the end 24 whereby the rods 10 and 12 act as a guide for the guide plate 22 to travel along. The end plate 66, rods 62, guide plate 22 and end plate 66 form the first part of the feed frame. This slidably interconnected arrangement of the feed frame 60 and rods 12 and 10 results in the feed frame 60 being guided and supported at all times, by four rods, which results in a very stable and rigid travel mechanism for a drilling unit 72, which may give it a relatively high level of accuracy.

The second part of the feed frame 60 is made up of cylindrical rods 68 and 70 which are also connected at their respective ends to both guide plate 22 and end plate 66. At the end plate 66, the rods 68 and 70 are connected near to the ends of the legs of the U of the U-shaped end plate 66.

Slidably mounted on the rods 68 and 70 is a drilling unit 72. By the arrangement of these components, the feed frame 60 acts as a carriage means to carry the drilling unit 72. The drilling unit 72 includes a hydraulic motor 74 having a hexagonal drive (not shown), into which can be fitted the hexagonal end of a drill rod or a hexagonal nut on the end of a roof bolt 16. When placed in the hexagonal drive 76, a drill rod or roof bolt can be rotated to either drill a hole in a rock surface or alternatively rotate the roof bolt so as to mix resin placed in the hole and thus ultimately secure the bolt and tighten the nut to provide an anchor mechanism.

The drilling unit 72 has bores 78 and 80 through its housing in its left and right hand ends, which act as sleeves. The drilling unit 72, via the bores 78 and 80, is slidably mounted on the rods 68 and 70 of feed frame 60. The rods 68 and 70 and bores 78 and 80 of drilling unit 72 together form a third travel means or mechanism.

The rods 62, 64, 68 and 70 are manufactured in a similar manner to those of rods 10 and 12. These rods are also manufactured from high tensile steel which are given a hard chrome finish.

The hydraulic cylinder has an inner stage cylinder rod 92 and an outer stage cylinder rod 94. The inner stage cylinder rod 92 is secured at its lowest end to the ported block 18. The outer stage cylinder rod 94 is secured at its respective ends to the end plate 66 and guide plate 22.

At the bottom end and on either side of the hydraulic cylinder 90 are pulleys (not shown). At the top end and on either side of the hydraulic cylinder 90 are additional pulleys (not shown). The drilling unit 72 is connected to the ends of chains (not shown). The chains pass over both sets of pulleys and are secured at their ends to the feed frame. More details of the roof bolter can be found by reference to Neilson et al. U.S. Pat. No. 6,105,684.

Figure 4:
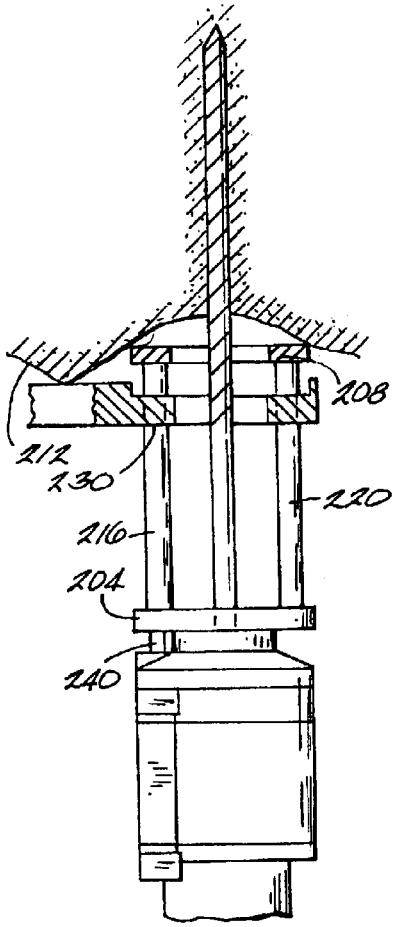
FIG. 4 is a side view of the roof bolt installation apparatus including a drill depth control device shown in FIG. 1 with the drill unit engaging the mine roof.

The roof bolt installation apparatus 2 also includes a drill depth control device 200 including a base 204, a top 208 (see FIG. 4) adapted to engage a mine roof 212, and at least two bars 216 and 220 connected between the drill depth control base and the drill depth control top 208. The bars pass through openings in the drill stabilizing plate 14.

More particularly, the drill depth control base 204 is configured to sit on top of and be engaged by the drilling unit 72. Since most drilling units have a circular upper housing, the base 204 of the drill control 200 is circular in this environment. In other embodiments, the base can have other shapes. In the preferred embodiment, the drill depth control has four bars 216, 220, 224 and 228 (see FIG. 1) that are spaced apart and extending between the top 208 and bottom 204 of the drill depth control device 200. At least two of the bars, and in the preferred embodiment, all 4 of the bars, pass-through openings 230 in the drill stabilizing end plate 14. Located within the drill stabilizing end plate openings 230 bushings (not shown). The bushings facilitate easy movement of the depth control device through the openings 230 in the drill stabilizing and plate 14.

In the preferred embodiment, the top 208 is square. In other embodiments other shapes can be used. The top 208 is sized so as to permit a roof anchor plate (not shown), designed to engage the mine roof to pass through the opening in the top 208 of the drilled depth control device 200. In other embodiments (not shown), a smaller top can be used, and the roof bolt plate can sit on top of the drill depth control device 200. One of the primary advantages of the invention is that the drill depth control device top 208 is smaller than the drill stabilizing end plate 14. This permits the top of the drill depth control device to actually engage the true roof 212. This is despite the presence of depressions in the mine roof, or other irregularities in the mine roof.

In operation, as the drilling unit 72 moves up the roof bolt installation apparatus 2, it comes into engagement with the base 204 of the drill depth control device 200. This pushes the drill depth control device 200 up to where it eventually engages the mine roof 212. When this happens, the base 204 of the drill depth control device 200 comes into contact with a pilot valve 240 on the top of the drill unit 72. The pilot valve 240 is designed so that when it is engaged in a conventional way by contacting the drill stabilizing end plate 14, the drill unit can no longer continue moving up the roof bolt installation apparatus 2, but instead will now retract down the device. In this invention, the drilling unit pilot valve 240 engages the base of the drill depth control device 200, and it does not meet with sufficient resistance to move and open the valve. Once the drill depth control device 200 engages the mine roof 212, however, then the pilot valve 204 will open, causing the drill unit to move back down the roof bolt insulation apparatus.

The foregoing describes some embodiments of the present invention and modifications by those skilled in the art can be made thereto without departing from the scope of the present invention.

What is claimed is:

1. A roof bolt installation apparatus including a drill stabilizing means including a base having a cylindrical bore therein and a stabilizing rod extendable from said base and slidably located in said bore, said rod having a distal end, a drill stabilizing end plate mounted on said rod distal end, a drilling unit which is adapted to rotatably carry a drill, said drilling unit being slidably mounted on said drill stabilizing means, means for moving said drilling unit along said drill stabilizing means, and a drill depth control device including a base, a top adapted to engage a mine roof, at least two bars connected between the drill depth control base and the drill depth control top, said bars passing through openings in said drill stabilizing plate.

2. A roof bolt installation apparatus according to claim 1 wherein said drill depth control is square and said drill depth control device base is round.

3. A roof bolt installation apparatus according to claim 2 wherein said extendable rod end provides a guiding means for a roof bolt placed in said drilling unit.

4. A roof bolt installation apparatus according to claim 1 wherein there are four bars connected between the drill depth control base and the drill depth control top.

* * * * *